United States Patent [19]

Herriott

[11] Patent Number: 4,476,701

[45] Date of Patent: Oct. 16, 1984

[54] MAGNETIC LOCK AND KEY

[75] Inventor: Leslie V. Herriott, Wolverhampton, England

[73] Assignee: Lowe & Fletcher Limited, Walsall, England

[21] Appl. No.: 380,679

[22] PCT Filed: Sep. 3, 1981

[86] PCT No.: PCT/GB81/00178

§ 371 Date: May 3, 1982

§ 102(e) Date: May 3, 1982

[87] PCT Pub. No.: WO82/00845

PCT Pub. Date: Mar. 18, 1982

[30] Foreign Application Priority Data

Sep. 3, 1980 [GB] United Kingdom ..... 8028472

[51] Int. Cl.[3] ..... E05B 47/00

[52] U.S. Cl. ..... 70/276; 70/413

[58] Field of Search ..... 70/276, 386, 413, 362

[56] References Cited

U.S. PATENT DOCUMENTS 2,177,996 10/1939 Raymond .

4,228,667 10/1980 Herriott ..... 70/276

FOREIGN PATENT DOCUMENTS 2706919 8/1978 Fed. Rep. of Germany .

2305578 10/1976 France .

*Primary Examiner*—Robert L. Wolfe

*Attorney, Agent, or Firm*—Cushman, Darby & Cushman

[57] ABSTRACT

A lock for operation by a magnetic key has a magnetic locking element (47) which moves in aligned, longitudinal grooves formed in inner (10) and outer (18) members of the lock. When the locking element is aligned with a transverse channel (57) in the inner member, limited relative rotation of the members can occur.

11 Claims, 8 Drawing Figures

MAGNETIC LOCK AND KEY

This invention relates to a lock and key, there being associated with the key a permanent magnetic field and the lock comprising at least one magnetic locking element which can be moved from a locking position to a releasing position by the magnetic field of the key, when the key is applied to the lock.

A magnetic lock and key are described in U.S. Pat. No. 2,177,996. This lock comprises a hollow plug arranged for rotation within a sleeve. Axially extending grooves formed in the plug and sleeve collectively define a path along which a magnetic ball can be moved by the magnetic field of the key from a locking position to a releasing position. In the locking position, the ball is engageable with abutment surfaces at opposite sides of its path, these surfaces being formed on the plug and sleeve respectively, so that relative rotation of the plug and sleeve is restrained. In the sleeve, there is formed a circumferentially extending groove which communicates with the axially extending groove. When the ball is in its releasing position, it is aligned with the circumferentially extending groove so that relative rotation of the plug and sleeve is possible. A second magnetic ball is disposed in a similar pair of axially extending grooves which communicate with the circumferentially extending groove. The possibility of providing further magnetic locking balls is mentioned.

One disadvantage of the lock described in the aforesaid U.S. patent is that manufacture of the lock becomes unduly complex if the number of magnetic elements is increased. In order to provide a sufficiently large number of different locks and keys to ensure proper security, a number of locking elements exceeding two is required. The U.S. patent proposes that the number of different locks and keys which can be produced should be increased by varying the position relative to the grooves of a driving lug of the key. However, this simple mechanical expedient does not provide adequate security.

According to a first aspect of the present invention, there is provided a lock comprising an inner member, a hollow outer member in which the inner member is mounted and a magnetic element, wherein the inner and outer members collectively define a path to which the magnetic element is confined and along which the magnetic element can move between a releasing position and a locking position, the inner and outer members have respective abutment surfaces facing in opposite directions transverse to the length of said path and disposed at opposite sides of said path, said abutment surfaces are engageable concurrently with the magnetic element except when the magnetic element occupies its releasing position, whereby relative movement of the inner and outer members in said directions is restricted or prevented by engagement of the magnetic element with the abutment surface except when the magnetic element occupies its releasing position and wherein there is in the abutment surface of the inner member an opening which a part of the magnetic element can enter when the element is in its releasing position.

According to a second aspect of the invention, there is provided a lock comprising an inner member, a hollow outer member in which the inner member is mounted for turning relative thereto about an axis, a housing in which the outer member is received, an element which is movable by a key between a locking position in which it prevents relative turning of said members about the axis and a releasing position in which it permits at least limited relative turning of the members, and a stop element which releasably prevents turning of the outer member relative to the housing until the inner member has been turned through a predetermined angle to effect release of the outer member for turning with the inner member.

According to a third aspect of the invention, there is provided a lock comprising an inner member, a hollow outer member in which the inner member is mounted and a magnetic element, wherein the inner and outer members collectively define a path to which the magnetic element is confined and along which the magnetic element can move between a releasing position and a locking position, the inner and outer members have respective abutment surfaces facing in opposite directions transverse to the length of said path and disposed at opposite sides of said path, said abutment surfaces are engageable concurrently with the magnetic element except when the magnetic element occupies its releasing position, whereby relative movement of the inner and outer members in said directions is restricted or prevented by engagement of the magnetic element with the abutment surfaces except when the magnetic element occupies its releasing position, the inner and outer members are each formed with a respective groove, respective parts of said grooves collectively form said path and wherein one of the inner and outer members has an element extending across its groove between the ends thereof to limit travel of the magnetic element along the groove.

According to a fourth aspect of the invention, there is provided a lock comprising a tubular inner element, a sleeve in which the inner element is mounted and a magnetic element, wherein the inner element and sleeve collectively define a path to which the magnetic element is confined and along which the magnetic element can move between a releasing position and a locking position, the inner element and the sleeve have respective abutment surfaces facing in opposite directions transverse to the length of said path and disposed at opposite sides of said path, said abutment surfaces are engageable concurrently with the magnetic element except when the magnetic element occupies its releasing position, whereby relative movement of the inner element and sleeve in said directions is restricted or prevented by engagement of the magnetic element with the abutment surfaces except when the magnetic element occupies its releasing position and wherein the inner element and the sleeve have respective channels extending along their entire lengths and each containing a respective part of the magnetic element, the abutment surfaces being boundary surfaces of the channels.

According to a fifth aspect of the invention, there is provided a lock and key whereof the lock has an operating member which can be turned about an axis when the key is applied to the lock, said operating member can be locked in a selected one of a plurality of alternative positions upon withdrawal of the key from the lock and the lock includes a key-retaining member which also turns about the axis during operation of the lock and is adapted to retain the key except when the operating member is in one of said alternative positions. Because the key-retaining member participates in turning about the axis, it is not necessary to modify the shape of the key-retaining member according to the number of and relationship between the alternative positions in which the operating member can be locked.

According to a still further aspect of the invention, there is provided a key with which there is associated a permanent magnetic field, the key comprising a shank formed at least partly of magnetic material and having a pole face which has a longer dimension extending along the shank and a shorter dimension extending around the shank.

There is also provided in accordance with the invention the combination comprising a lock according to any one of the first, second, third and fourth aspects of the invention and a key having a shank which presents a plurality of magnetic poles and is adapted to transmit torque to at least one of the inner and outer members of the lock.

One example of a lock and key embodying each aspect of the invention will now be described, with reference to the accompanying drawings wherein.

Figure 2:
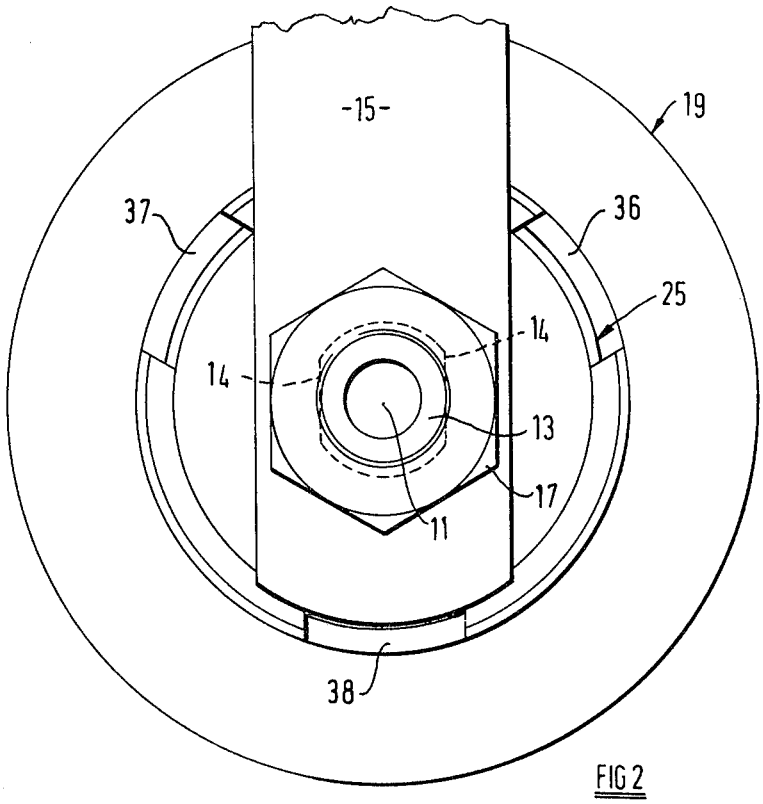
FIG. 2 shows an opposite end view of the lock.
Figure 1:
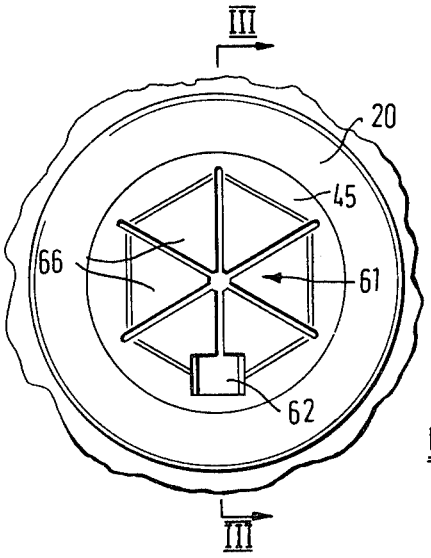
FIG. 1 shows an end view of the lock, the key being absent from the lock.

The lock illustrated in the accompanying drawings comprises an inner member 10 of generally cylindrical form having a longitudinal axis 11 about which the inner member is turned by means of a key 12 during operation of the lock. On an end portion 13 of the inner member, called herein the rear end portion, there is formed a pair of flats 14 which engage an operating arm 15 within a non-circular opening of the arm. The arm is trapped on the inner member between a circlip 16 and a nut 17. The arm 15 is used to control a device which is to be controlled by the lock. For example, the arm itself may be a latch. Alternatively, there may be formed on the arm a cam surface which co-operates with an element (not shown) controlled by the lock.

The lock further comprises a hollow outer member 18, also of generally cylindrical form, within which the inner member 10 is mounted. The outer member is concentric with the inner member and is a sliding fit on the inner member.

The outer member 18 is disposed within a housing 19, relative to which the outer member can turn about the axis 11 when the proper key is used to operate the lock. The shape of the housing may be selected according to the intended use of the lock. As illustrated, the housing may be formed in a plurality of parts, at least some of which may be provided with screw threads to enable the parts of the housing to be releasably secured together. In the example illustrated, a front part 20 of the housing extends through an opening in a mounting plate 21 and is secured therein by a nut 22 screwed onto the front housing part. The entire housing will normally be fixed during use of the lock.

A stop element 23 is provided for releasably preventing turning of the outer member 18 relative to the housing 19 until the inner member 10 has been turned by means of the key 12 through a predetermined angle to effect release of the outer member. The stop element is in the form of a bolt having a central opening through which the rear end portion 13 of the inner member protrudes. The bolt is held against a rear end face 24 of the outer member 18 by a bolt carrier 25. The bolt carrier is of hollow, generally cylindrical form having one end wall and an external diameter equal to that of the outer member 18. The bolt carrier has three limbs 26, 27, 28 which project from the end wall of the carrier in the forward direction through the central aperture of the bolt. Five grooves are formed in the external surface of the inner member 10, each of these grooves being rectilinear, parallel to the axis 11 and extending along the entire length of the inner member. The limbs 26, 27 and 28 of the bolt carrier engage in respective ones of these grooves indicated by the reference numerals 29, 30 and 31. The bolt carrier is thereby constrained to turn about the axis 11 with the inner member relative to the bolt and the outer member.

There is formed in the wall of the outer member 18 adjacent to the rear end thereof an opening 32. Openings having dimensions extending circumferentially of the axis 11 similar to the corresponding dimension of the opening 32 are formed in a rear part 33 of the housing 19 adjacent to a rear wall 34 of the housing. In the example illustrated, there are four of these openings in the housing identified by the reference numerals 35 to 38. The bolt 23 has a nose 39 which can protrude through the opening 32 into any selected one of the openings 35 to 38 and thereby restrain turning of the outer member 18 about the axis 11 relative to the housing. The bolt is urged into the active position illustrated in FIG. 3 by a leaf spring 40 having a mid portion which bears against the bolt and end portions which bear against the internal face of the outer member 18. Engagement of the nose 39 of the bolt in the opening 32 prevents turning of the bolt relative to the outer member.

Figure 4:
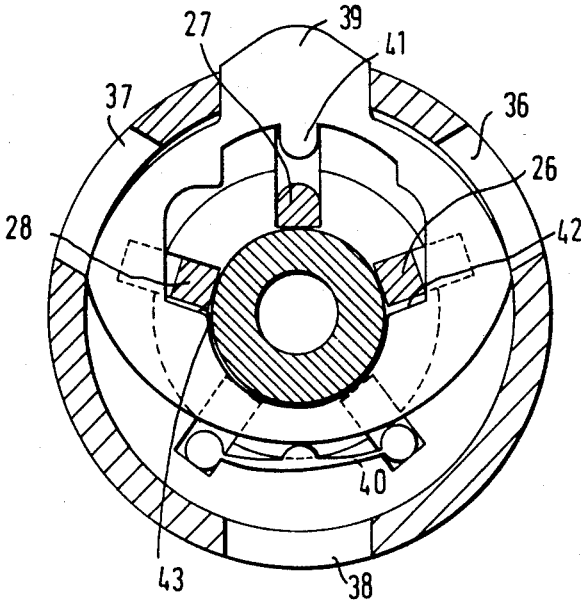
FIG. 4 shows a cross-section on the line IV—IV of the lock and key, prior to rotation of the key.
Figure 6:
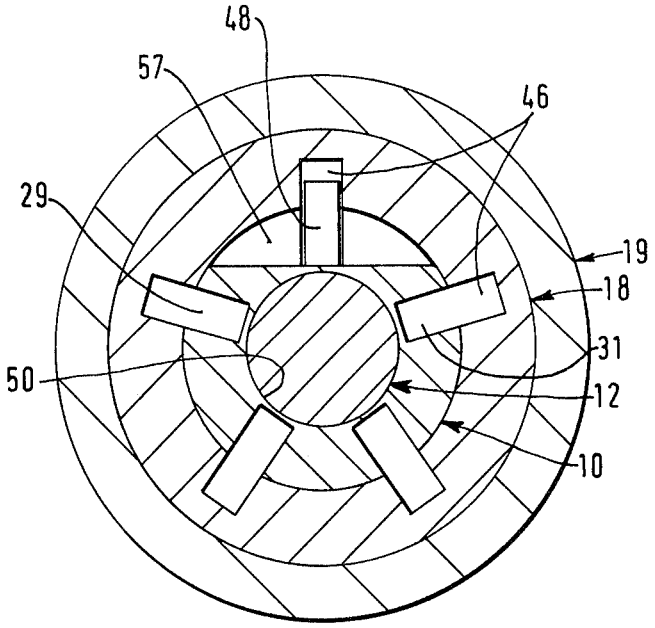
FIG. 6 shows a cross-section on the line VI—VI of FIG. 3, prior to turning of the key.
Figure 7:
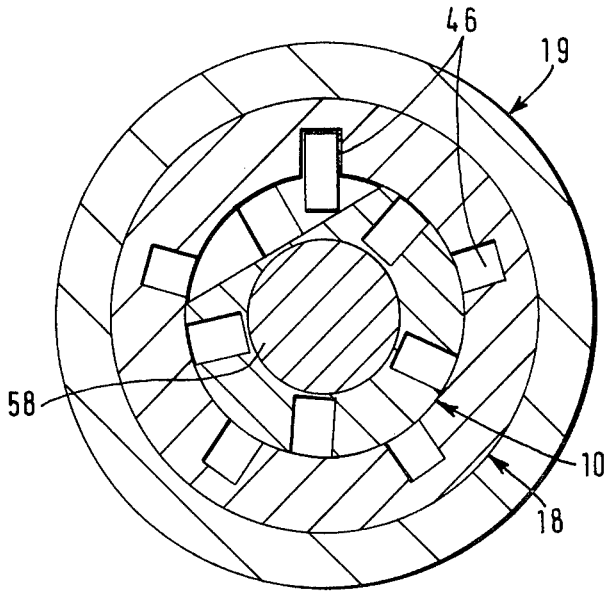
FIG. 7 shows a cross-section on the line VI—VI after the key has been rotated through an angle of 30°.
Figure 8:
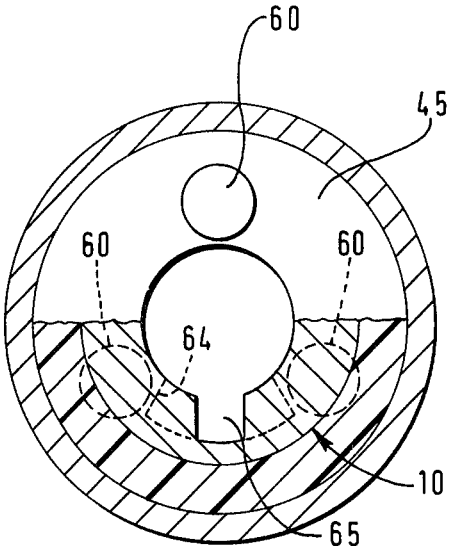
FIG. 8 shows a cross-section of the lock on the line VIII—VIII of FIG. 3.

From the nose 39 there projects into the central opening of the bolt 23 an abutment 41 of the bolt. When the key is absent from the lock, the abutment 41 is aligned with the limb 27 of the bolt carrier 25 as shown in FIG. 4 so that complete withdrawal of the bolt from the opening of the housing is prevented by engagement of the abutment 41 with the limb 27 which constitutes an abutment of the bolt carrier.

Figure 5:
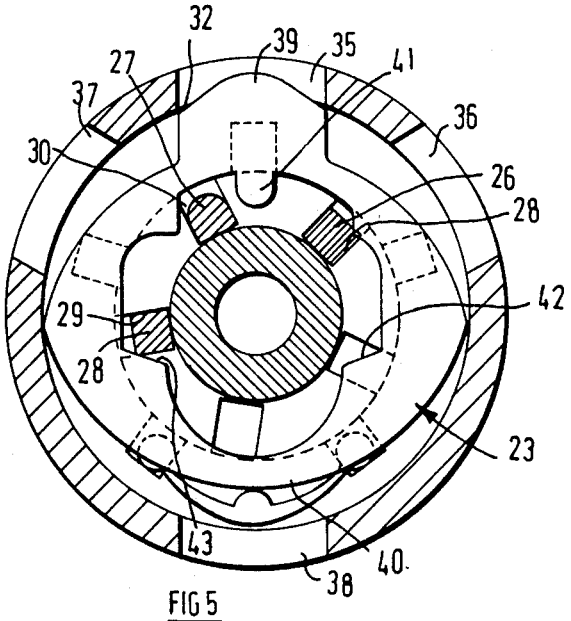
FIG. 5 shows a cross-section on the line IV—IV of FIG. 3 after the key has been rotated through an angle of 30°.

If the key 12 is inserted into the inner member 10 and the key and inner member are then turned in either direction about the axis 11, the limb 27 is moved out of alignment with the abutment 41 so that the nose 39 of the bolt can move towards the axis 11. Turning of the inner member in either direction also brings one or other of the limbs 26 and 28 into engagement with a respective surface 42 or 43 on the bolt which faces generally in a direction away from the leaf spring 40 and towards the nose 39. Further turning of the inner member causes the bolt to slide between the end face 24 of the outer member and the end wall of the bolt carrier in a direction transverse to the axis 11 until the nose 39 is substantially withdrawn from the opening of the housing. As shown, the nose 39 may be provided with a rounded tip which will automatically be forced out of the opening in the housing upon rotation of the bolt and outer member relative to the housing, provided the nose is substantially withdrawn from the opening of the housing before rotation of the outer member commences. Thus, by turning of the inner member 10 the bolt can be moved to the releasing position illustrated in FIG. 5 in which it no longer restrains rotation of the outer member 18.

The outer member 18 consists of a tubular element 44 and an end cap 45 secured on the front end of the element 44. In the internal surface of the element 44, there is formed a number of grooves equal to the number of grooves provided in the external surface of the inner member 10. The circumferential extent and spacing between the grooves 46 of the outer member are the same as those of the grooves of the inner member so that each of the grooves 46 can be aligned with a corresponding groove of the inner member. The grooves 46 also extend along the entire length of the element 44 and are parallel to the axis 11. Three magnetic elements 47, 48 and 49 are each disposed partly in the groove 30 of the inner member and partly in the corresponding groove 46 of the outer member. In the particular example illustrated, each magnetic element is in the form of a hollow cylinder having flat end faces which are engageable with boundary surfaces of the grooves 30 and 46. In the example illustrated, each of these grooves has a transverse cross-section of rectangular shape with flat abutment surfaces at opposite sides of the grooves.

Figure 3:
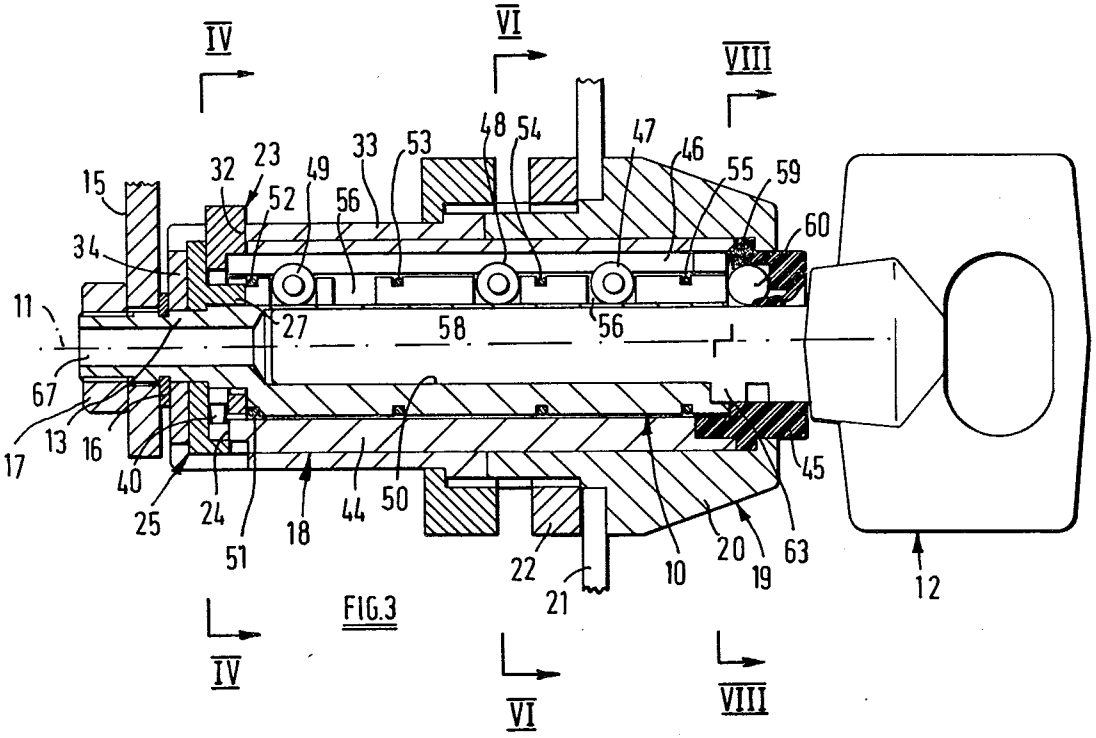
FIG. 3 shows a cross-section on the line III—III of FIG. 1, together with a key of which the shank is present in the lock.

The groove 30 extends through a major part of the thickness of the inner member 10, almost to the central bore 50 thereof. There are also formed in the outer surface of the inner member 10 a plurality of relatively shallow circumferentially extending grooves 51 containing respective rings 52 to 55. The ring 52 lies adjacent to the rear end of the inner member. The rings 53 to 55 lie between the ends of the groove 30 and are spaced apart from each other along the axis 11. As shown in FIG. 3, the magnetic elements 47 to 49 lie between respective different pairs of the rings 52 to 55 so that travel of the magnetic elements along the groove 30 is limited to prevent two or more magnetic elements occupying the same part of the groove. In the absence of the key, each magnetic element is free to move along a respective path defined collectively by the boundary surfaces of the grooves 30 and 46, these paths being colinear and parallel to the axis 11.

In the abutment surfaces at opposite sides of the groove 30, there are formed openings 56 which are sufficiently large to receive that part of a magnetic element 47 to 49 which is normally disposed in the groove 30. In the example illustrated, there is in each abutment surface a single opening for the element 47, a single opening for the element 48 and two axially spaced openings for the element 49. The openings 56 are formed by the provision of transversely extending channels in the external surface of the inner member 10.

The boundary surface of each transverse channel 57 which faces away from the axis 11, that is the base of the channel, is such that there can be drawn on the base of the channel a rectilinear line transverse to the length of the groove 30. At the position where a transverse channel 57 intersects the groove 30, the depth of the transverse channel is equal to that of the groove. The depth of the transverse channel decreases gradually in both directions away from the groove 30 until the transverse channel runs out onto the external surface of the inner member. In the particular example illustrated, the base of each transverse channel is flat.

When any one of the magnetic elements 47, 48 and 49 is not aligned with a corresponding one of the transverse channels 57, that element is said to be in a locking position and, by engagement with opposed abutment surfaces of the inner and outer members, it prevents or restricts turning of the inner member about the axis 11 relative to the outer member. When the key is absent from the lock, at least some and usually all of the magnetic elements will occupy locking positions.

It will be noted that the depth of the groove 30 significantly exceeds one half of the corresponding dimension of the magnetic elements and that the depth of the grooves 46 is similar to that of the groove 30. However, the depth of these grooves is significantly less than the corresponding dimension of the magnetic elements. There is associated with the key 12 a permanent magnetic field such that, when a shank 58 of the key is introduced into the central bore 50 of the inner member, each of the magnetic elements is biased by the magnetic field into a releasing position where it is aligned with a respective one of the transverse channels 57. Thus, the magnetic elements are no longer engaged between oppositely facing abutment surfaces and the inner member can be turned about the axis 11 in either direction relative to the outer member 18. Since a part of each magnetic element remains in the groove 46, such turning causes each magnetic element to move along the base of the corresponding transverse channel and therefore to move further away from the axis 11. Before such movement is interrupted by engagement of the magnetic elements with a radially inwardly facing surface of the outer member, the outer member itself is freed for turning movement with the inner member by retraction of the nose 39 of the bolt from the opening in the housing 19. Continued turning of the inner member 10 is then accompanied by turning of the outer member relative to the housing. The inner member is turned sufficiently to bring about operation of an associated device by means of the arm 15.

The arm 15 can be locked in a selected angular position by turning the inner member 10 in the reverse direction relative to the outer member 18 whilst the nose 39 of the bolt is aligned with a selected one of the openings 35 to 38 in the housing 19. Such alignment is indicated to a user by noticably increased resistance to turning of the inner member 10 which is necessary to force the rounded tip of the nose 39 out of one of the openings in the housing, against the action of the spring 40. It will be understood that reverse rotation of the inner member 10 relative to the outer member 18 causes the magnetic elements 47, 48 and 49 to move along their respective transverse channels 57 into alignment with the groove 30 once more. Withdrawal of the key then displaces the magnetic elements along their respective paths of movement into locking positions.

In the end cap 45, there are formed three recesses 59 having open sides facing along the axis 11 towards the inner member 10. In each of these recesses there is disposed a freely rotatable ball 60 of hardened steel. These balls prevent the drilling away of the end cap so that the inner member 10 can be withdrawn from the outer member 18. The end cap also defines a non-circular opening 61 through which the key shank can be introduced into the bore 50 of the inner member. The opening 61 comprises a circular portion having the same diameter as, and being aligned with, the bore 50 and a rectangular extension 62 of the circular portion. The shank 58 of the key is of generally cylindrical form but has, adjacent to a handle of the key, a radially projecting lug 63 having dimensions such that it can pass through the extension 62 of the opening in the end cap. Immediately adjacent to the opening 61 and between that opening and the inner member 10, there is in the end cap 45 an arcuate recess 64 which accommodates the lug 63 of the key when the key is turned relative to the outer member 18 through an angle of 30° in either direction after the lug has passed through the opening 61. After the key has been turned through an angle of 30° relative to the outer member, torque can be transmitted from the key to the outer member by engagement of the lug 63 with boundary surfaces of the recess 64.

The lug 63 also transmits torque to the inner member 10 by engaging in a recess 65 at the front end thereof. There is only a small clearance between the lug 63 and the boundary surfaces of the recess 65 so that no significant turning of the key relative to the inner member 10 is permitted. It will be seen that portions of the end cap 45 bordering the rectangular extension 62 of the opening therein trap the key in the bore 50 of the inner member whenever the nose 39 of the bolt is withdrawn or substantially withdrawn from the openings 35 to 38 of the housing. Only when the nose 39 is engaged in an opening of the housing can be the limb 27 be moved into alignment with the abutment 41 to align the lug 63 with the extension 62 of the opening in the end cap and thereby permit extraction of the key from the lock.

The end cap 45 may include flaps 66 which substantially close the openings of the end cap when the key is absent from the lock. The end cap is preferably formed of a resilient plastics material by a moulding process.

The inner member 10 and the tubular element 44 of the outer member are preferably formed of a non-magnetic metal, for example aluminium or brass. Since the groove 30 and other grooves of the inner member and the grooves 46 of the outer member are rectilinear and extend along the entire lengths of the inner member and element 44 respectively, these grooves can conveniently be formed by an extrusion process. This has the advantage that smooth abutment surfaces on the inner and outer members can be achieved without careful machining of the inner and outer members. The other grooves and openings in the inner and outer members are formed by machining extruded tubular workpieces. It will be noted that each transverse channel 57 can be formed by a single straight cut across the inner member 10.

The inner member 10 is preferably formed by extrusion with a central opening 67 of smaller diameter than the bore 50, the bore subsequently being formed in the inner member by machining. It will be noted from FIG. 3 that the bore 50 does not extend into the rear end portion 13 of the inner member.

The key shank 58 is provided with magnetic pole faces at positions corresponding to respective paths of the magnetic elements. Each pole face has a length, measured along the axis 11, which exceeds its width, measured circumferentially of the axis 11 and a maximum flux density at a position corresponding to the releasing position of the associated magnetic element. In the example illustrated, the magnetic element 49 has two releasing positions and is moved into one of these positions by a master key and into the other position by another key.

It will be understood that the number of magnetic elements in each groove of the inner member can be varied. In the particular example described, only one groove of the inner member contains magnetic elements but generally more than one groove will contain at least one magnetic element. Locks will also differ one from the other in respect of the relation between the releasing position of each magnetic element and the ends of its path of movement.

By appropriate choice of the relative positions of the paths of the magnetic elements, the magnetic pole faces of the key can be spaced well apart. This facilitates the establishment of high flux densities at the magnetic poles so that reliable operation of the lock by the key is assured even under adverse conditions.

I claim:

1. A lock comprising an inner member, a hollow outer member in which the inner member is mounted and a plurality of magnetic elements, wherein the inner and outer members collectively define respective paths to which the magnetic elements are confined and along which the magnetic elements can move between respective releasing positions and respective locking positions, the inner and outer members have, for each path, respective abutment surfaces facing in opposite directions transverse to the length of the path and disposed at opposite sides of the path and said abutment surfaces are engageable concurrently with respective ones of the magnetic elements when the magnetic elements occupy their locking positions, whereby relative movement of the inner and outer members in said directions is restricted or prevented by engagement of the magnetic elements with the abutment surfaces except when the magnetic elements occupy their releasing positions, characterised in that there are in the abutment surfaces of the inner member openings corresponding to respective ones of the magnetic elements and each of which openings a part of the corresponding magnetic element can enter when the element is in its releasing position and in that means is provided for preventing movement of one of said magnetic elements into the opening corresponding to another of the magnetic elements.

2. A lock according to claim 1 wherein said openings are formed by the intersection of respective transverse channels and said paths, one boundary of each transverse channel being a respective surface of the inner member which faces towards the outer member and contains a rectilinear line transverse to the corresponding path.

3. A lock according to claim 2 wherein each transverse channel extends from the corresponding path in opposite directions.

4. A lock according to claim 2 wherein said surface of each transverse channel is flat.

5. A lock according to claim 1 wherein, when the locking element is in its releasing position, the inner and outer members can undergo limited relative rotation about an axis parallel to the length of said path.

6. A lock comprising an inner member, a hollow outer member in which the inner member is mounted, a housing for the outer member and a plurality of magnetic elements, wherein the inner and outer members collectively define respective paths to which the magnetic elements are confined and along which the magnetic elements can move between respective releasing positions and respective locking positions, the inner and outer members have, for each path, respective abutment surfaces facing in opposite directions transverse to the length of the path and disposed at opposite sides of the path and said abutment surfaces are engageable concurrently with respective ones of the magnetic elements when the magnetic elements occupy their locking positions, whereby relative movement of the inner and outer members in said directions is restricted or prevented by engagement of the magnetic elements with the abutment surfaces except when the magnetic elements occupy their releasing positions, characterised in that there are in the abutment surfaces of the inner member openings corresponding to respective ones of the magnetic elements and each of which of openings a part of the corresponding magnetic elements can enter when the element is in its releasing position, in that means is provided for preventing movement of one of said magnetic elements into the opening corresponding to another of the magnetic elements, in that, when the locking elements are in their releasing positions, the inner and outer members can undergo limited rotation about an axis parallel to the lengths of said paths and in that there is provided a stop element which releasably prevents turning of the outer member relative to the housing until the inner member has been turned through a predetermined angle to effect release of the outer member for turning with the inner member.

7. A lock according to claim 6 wherein the stop element is a slidable bolt which is movable transversely of the axis between an active position and an inactive position, in its active position the bolt engages in respective openings in the outer member and in the housing and the inner member has an abutment which, when the locking element is in its locking position, is engageable with the bolt to prevent movement of the bolt from its active position to is inactive position.

8. A lock according to claim 7 wherein the housing has a plurality of openings, in any selected one of which the bolt can engage to restrain turning of the outer member relative to the housing.

9. A lock according to claim 1 wherein the inner member has a bore to receive a shank of the key, the outer member defines a noncircular aperture through which the key shank can be introduced into the bore of the inner member and there is adjacent to the aperture a space which can accommodate a non-circular part of the key shank complementary to said aperture after such part has been passed through the aperture and then turned about the axis to trap the key shank in the outer member.

10. A lock according to claim 1 wherein at least one of said inner and outer members is formed by an extrusion process with respective channels each extending from one end of the member to the other end and a part of the magnetic element is received in the channel.

11. A lock according to claim 1 wherein said inner and outer members are each formed with a respective groove, respective parts of said grooves collectively form the path for at least one magnetic element and wherein one of the inner and outer members has an element extending across its groove between the ends thereof to limit travel of the magnetic element along the grooves.

* * * * *